US008789769B2

(12) United States Patent
Fenton et al.

(10) Patent No.: US 8,789,769 B2
(45) Date of Patent: Jul. 29, 2014

(54) MIST GENERATING APPARATUS AND METHOD

(75) Inventors: Marcus Brian Mayhall Fenton, St. Neots (GB); Alexander Guy Wallis, Adelaide (AU)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 649 days.

(21) Appl. No.: 12/381,584

(22) Filed: Mar. 13, 2009

(65) Prior Publication Data

US 2009/0314500 A1 Dec. 24, 2009

Related U.S. Application Data

(63) Continuation-in-part of application No. PCT/GB2007/003492, filed on Sep. 14, 2007.

(30) Foreign Application Priority Data

Sep. 15, 2006 (GB) ..... 0618196.0

(51) Int. Cl.
*B05B 7/06* (2006.01)

(52) U.S. Cl.
USPC ..... 239/428; 239/431; 239/434; 239/422; 239/424; 239/427.5; 239/429

(58) Field of Classification Search
USPC ..... 239/338, 368, 369, 426, 428, 429–431, 239/433, 434, 434.5, 416.1, 416.4, 416.5, 239/418, 419, 421, 422, 423, 424, 427, 239/427.5, 8; 169/14, 15
See application file for complete search history.

(56) References Cited

U.S. PATENT DOCUMENTS 1,004,770 A 10/1911 Galloway
1,289,812 A 12/1918 Kinney
(Continued)

FOREIGN PATENT DOCUMENTS

CA 833980 2/1970
CN 2356760 1/2000
(Continued)

OTHER PUBLICATIONS

International Preliminary Report on Patentability including Written Opinion of the ISA for PCT/GB2007/003492, dated Mar. 17, 2009.
(Continued)

*Primary Examiner* — Jason Boeckmann
(74) *Attorney, Agent, or Firm* — Perkins Coie LLP

(57) ABSTRACT

Apparati for generating a mist are disclosed. One apparatus is disclosed, which has an elongate hollow body (12) and an elongate member (14) located within the body (12). A transport fluid passage (16) and a nozzle (32) are defined between the body (12) and the elongate member (14). The transport fluid passage (16) has a throat portion of reduced cross-sectional area and is in fluid communication with the nozzle (32). The elongate member (14) includes a working fluid passage (26) and one or more communicating openings, such as for example, bores, annuli, and combinations thereof, (30) extending radially outward from the working fluid passage (26). The openings (30) permit a working fluid (e.g. water) to be passed into the transport fluid passage (16), whereupon the working fluid is subjected to shear forces by a high velocity transport fluid (e.g. steam). The shearing of the working fluid results in the generation of a mist formed from droplets of substantially uniform size. Methods of generating a mist using such apparati are also disclosed. Also provided are mists for fire suppression produced using an apparatus disclosed herein, as well as fire suppression systems that include any of the apparati disclosed herein. Further provided are devices, methods, and mists for various other applications including turbine cooling and decontamination.

6 Claims, 5 Drawing Sheets

(56) References Cited

U.S. PATENT DOCUMENTS

| | | | | |
|---|---|---|---|---|
| 1,592,448 | A | 7/1926 | Debus | |
| 2,083,801 | A | 6/1937 | Eddy | |
| 2,396,290 | A | 3/1949 | Schwarz | |
| 2,971,325 | A | 2/1961 | Gongwer | |
| 3,199,790 | A * | 8/1965 | Giesemann | 239/428 |
| 3,259,320 | A | 7/1966 | Christian | |
| 3,265,027 | A | 8/1966 | Brown | |
| 3,304,564 | A | 2/1967 | Green et al. | |
| 3,402,555 | A | 9/1968 | Piper | |
| 3,411,301 | A | 11/1968 | Olsen | |
| 3,456,871 | A | 7/1969 | Gosling | |
| 3,493,181 | A * | 2/1970 | Hershel et al. | 239/419.3 |
| 3,493,191 | A | 2/1970 | Hughes | |
| 3,529,320 | A | 9/1970 | Kerns et al. | |
| 3,664,768 | A | 5/1972 | Mays et al. | |
| 3,799,195 | A | 3/1974 | Hermans | |
| 3,823,929 | A | 7/1974 | Rymarchyk | |
| 3,889,623 | A | 6/1975 | Arnold | |
| 3,984,504 | A | 10/1976 | Pick | |
| 4,014,961 | A | 3/1977 | Popov | |
| 4,072,470 | A * | 2/1978 | Tsuto et al. | 422/242 |
| 4,101,246 | A | 7/1978 | Erickson | |
| 4,157,304 | A | 6/1979 | Molvar | |
| 4,175,706 | A | 11/1979 | Gerstmann | |
| 4,192,465 | A | 3/1980 | Hughes | |
| 4,201,596 | A | 5/1980 | Church et al. | |
| 4,212,168 | A | 7/1980 | Bouchard et al. | |
| 4,221,558 | A | 9/1980 | Santisi | |
| 4,279,663 | A | 7/1981 | Burroughs et al. | |
| 4,425,433 | A | 1/1984 | Neves | |
| 4,461,648 | A | 7/1984 | Foody | |
| 4,487,553 | A | 12/1984 | Nagata | |
| 4,659,521 | A | 4/1987 | Alleman | |
| 4,718,870 | A | 1/1988 | Watts | |
| 4,738,614 | A | 4/1988 | Snyder et al. | |
| 4,809,911 | A | 3/1989 | Ryan | |
| 4,836,451 | A | 6/1989 | Herrick et al. | |
| 4,915,300 | A | 4/1990 | Ryan | |
| 4,915,302 | A | 4/1990 | Kraus et al. | |
| 5,014,790 | A | 5/1991 | Papavergos | |
| 5,061,406 | A | 10/1991 | Cheng | |
| 5,138,937 | A | 8/1992 | Zietlow | |
| 5,171,090 | A | 12/1992 | Wiemers | |
| 5,205,648 | A | 4/1993 | Fissenko | |
| 5,240,724 | A | 8/1993 | Otto et al. | |
| 5,249,514 | A | 10/1993 | Otto et al. | |
| 5,252,298 | A | 10/1993 | Jones | |
| 5,269,461 | A | 12/1993 | Davis | |
| 5,275,486 | A | 1/1994 | Fissenko | |
| 5,312,041 | A | 5/1994 | Williams et al. | |
| 5,323,967 | A | 6/1994 | Tanaka et al. | |
| 5,338,113 | A | 8/1994 | Fissenko | |
| 5,344,345 | A | 9/1994 | Nagata | |
| 5,366,288 | A | 11/1994 | Dahllof et al. | |
| 5,492,276 | A | 2/1996 | Kaylor | |
| 5,495,893 | A | 3/1996 | Roberts et al. | |
| 5,520,331 | A | 5/1996 | Wolfe | |
| 5,544,961 | A | 8/1996 | Fuks et al. | |
| 5,597,044 | A | 1/1997 | Roberts et al. | |
| 5,598,700 | A | 2/1997 | Varshay et al. | |
| 5,615,836 | A | 4/1997 | Graef | |
| 5,661,968 | A | 9/1997 | Gabriel | |
| 5,692,371 | A | 12/1997 | Varshay et al. | |
| 5,738,762 | A | 4/1998 | Ohsol | |
| 5,779,159 | A | 7/1998 | Williams et al. | |
| 5,810,252 | A | 9/1998 | Pennamen et al. | |
| 5,851,139 | A | 12/1998 | Xu | |
| 5,857,773 | A | 1/1999 | Tammelin | |
| 5,860,598 | A | 1/1999 | Cruz | |
| 5,863,128 | A | 1/1999 | Mazzei | |
| 6,003,789 | A | 12/1999 | Base et al. | |
| 6,029,911 | A | 2/2000 | Watanabe et al. | |
| 6,065,683 | A | 5/2000 | Akin et al. | |
| 6,098,896 | A | 8/2000 | Haruch | |
| 6,110,356 | A | 8/2000 | Hedrick et al. | |
| 6,200,486 | B1 | 3/2001 | Chahine et al. | |
| 6,299,343 | B1 | 10/2001 | Pekerman | |
| 6,308,740 | B1 | 10/2001 | Smith et al. | |
| 6,325,618 | B1 * | 12/2001 | Benz et al. | 431/187 |
| 6,338,444 | B1 | 1/2002 | Swan | |
| 6,371,388 | B2 | 4/2002 | Utter et al. | |
| 6,405,944 | B1 | 6/2002 | Benalikhoudja | |
| 6,456,871 | B1 | 9/2002 | Hsu et al. | |
| 6,478,240 | B1 | 11/2002 | Dorkin et al. | |
| 6,502,979 | B1 | 1/2003 | Kozyuk | |
| 6,503,461 | B1 | 1/2003 | Burgard et al. | |
| 6,523,991 | B1 | 2/2003 | Maklad | |
| 6,623,154 | B1 | 9/2003 | Garcia | |
| 6,637,518 | B1 | 10/2003 | Hillier et al. | |
| 6,662,549 | B2 | 12/2003 | Burns | |
| 6,796,704 | B1 | 9/2004 | Lott | |
| 6,802,638 | B2 | 10/2004 | Allen | |
| 6,830,368 | B2 | 12/2004 | Fukano | |
| 6,969,012 | B2 | 11/2005 | Kangas et al. | |
| 7,029,165 | B2 | 4/2006 | Allen | |
| 7,040,551 | B2 | 5/2006 | Rummel | |
| 7,080,793 | B2 | 7/2006 | Borisov et al. | |
| 7,111,975 | B2 | 9/2006 | Fenton et al. | |
| 7,207,712 | B2 | 4/2007 | Kozyuk | |
| 7,667,082 | B2 | 2/2010 | Kozyuk | |
| 2002/0162518 | A1 | 11/2002 | Dumaz et al. | |
| 2003/0147301 | A1 | 8/2003 | Ekholm | |
| 2003/0150624 | A1 | 8/2003 | Rummel | |
| 2004/0065589 | A1 | 4/2004 | Jorgensen | |
| 2004/0140374 | A1 * | 7/2004 | Snyder et al. | 239/418 |
| 2004/0141410 | A1 | 7/2004 | Fenton et al. | |
| 2004/0188104 | A1 | 9/2004 | Borisov et al. | |
| 2004/0222317 | A1 | 11/2004 | Huffman | |
| 2005/0000700 | A1 | 1/2005 | Sundholm | |
| 2005/0011355 | A1 | 1/2005 | Williams et al. | |
| 2005/0150971 | A1 | 7/2005 | Zhou | |
| 2005/0266539 | A1 | 12/2005 | Hochberg et al. | |
| 2006/0102351 | A1 | 5/2006 | Crabtree et al. | |
| 2006/0102749 | A1 | 5/2006 | Crabtree et al. | |
| 2006/0144760 | A1 | 7/2006 | Duyvesteyn et al. | |
| 2007/0000700 | A1 | 1/2007 | Switzer | |
| 2007/0095946 | A1 | 5/2007 | Ryan | |
| 2007/0128095 | A1 | 6/2007 | Brockmann et al. | |
| 2007/0210186 | A1 | 9/2007 | Fenton et al. | |
| 2008/0230632 | A1 | 9/2008 | Fenton et al. | |
| 2008/0310970 | A1 | 12/2008 | Fenton et al. | |
| 2009/0052275 | A1 | 2/2009 | Jansson | |
| 2009/0072041 | A1 | 3/2009 | Hashiba | |
| 2009/0240088 | A1 | 9/2009 | Fenton et al. | |
| 2009/0314500 | A1 | 12/2009 | Fenton et al. | |
| 2010/0085883 | A1 | 4/2010 | Zaiser | |
| 2010/0129888 | A1 | 5/2010 | Thorup et al. | |
| 2010/0230119 | A1 | 9/2010 | Worthy | |
| 2010/0233769 | A1 | 9/2010 | Heathcote et al. | |
| 2010/0301129 | A1 | 12/2010 | Fenton et al. | |
| 2011/0127347 | A1 | 6/2011 | Worthy et al. | |
| 2011/0203813 | A1 | 8/2011 | Fenton et al. | |
| 2012/0018531 | A1 | 1/2012 | Fenton et al. | |

FOREIGN PATENT DOCUMENTS

| | | |
|---|---|---|
| DE | 3316233 | 11/1984 |
| EP | 282061 | 3/1988 |
| EP | 0362052 | 10/1991 |
| EP | 0471321 | 11/1995 |
| EP | 0889244 | 1/1999 |
| EP | 0911082 | 4/1999 |
| EP | 1072320 | 1/2001 |
| EP | 1163931 | 12/2001 |
| EP | 1034029 | 3/2003 |
| EP | 1421996 | 5/2004 |
| EP | 1549856 | 6/2007 |
| EP | 2070881 | 6/2009 |
| FR | 474 904 | 3/1915 |
| FR | 1 354 965 | 3/1964 |
| FR | 2376384 | 7/1978 |
| FR | 2613639 | 10/1988 |
| GB | 995660 | 6/1965 |
| GB | 1028211 | 5/1966 |

(56) References Cited

FOREIGN PATENT DOCUMENTS

| | | |
|---|---|---|
| GB | 1205776 | 9/1970 |
| GB | 1227444 | 4/1971 |
| GB | 2207952 | 7/1988 |
| GB | 2242370 | 11/1993 |
| GB | 2313410 | 11/1997 |
| GB | 2384027 | 1/2002 |
| GB | 0223572.9 | 10/2002 |
| GB | 0227053.6 | 11/2002 |
| GB | 0301236.6 | 6/2003 |
| GB | 0404230.5 | 2/2004 |
| GB | 0405363.3 | 3/2004 |
| GB | 0406690.8 | 3/2004 |
| GB | 0407090.0 | 3/2004 |
| GB | 0409620.2 | 4/2004 |
| GB | 0410518.5 | 5/2004 |
| GB | 0416914.0 | 7/2004 |
| GB | 0416915.7 | 7/2004 |
| GB | 0417961.0 | 8/2004 |
| GB | 0428343.8 | 12/2004 |
| GB | 0500580.6 | 1/2005 |
| GB | 0500581.4 | 1/2005 |
| GB | 0618196.0 | 9/2006 |
| GB | 0708482.5 | 5/2007 |
| GB | 0710659.4 | 6/2007 |
| GB | 0710663.6 | 6/2007 |
| GB | 0721995.9 | 11/2007 |
| GB | 0803959.6 | 3/2008 |
| GB | 0805791.1 | 3/2008 |
| GB | 0806182.2 | 4/2008 |
| GB | 0810155.2 | 6/2008 |
| GB | 0818362.6 | 10/2008 |
| JP | 03-260405 | 11/1991 |
| JP | 2004-184000 | 6/1992 |
| JP | 10-141299 | 5/1998 |
| JP | 10-226503 | 8/1998 |
| JP | 2001-354319 | 12/2001 |
| JP | 2003-515702 | 5/2003 |
| NL | 7409053 | 1/1975 |
| RU | 2040322 | 5/1992 |
| RU | 2142580 | 12/1999 |
| RU | 2152465 | 7/2000 |
| SU | 1653853 | 6/1991 |
| WO | WO 89/07204 | 8/1989 |
| WO | WO 89/10184 | 11/1989 |
| WO | WO 92/20453 | 11/1992 |
| WO | WO 92/20454 | 11/1992 |
| WO | WO 94/08724 | 4/1994 |
| WO | WO 97/00373 | 1/1997 |
| WO | WO 97/38757 | 10/1997 |
| WO | PCT/US98/005275 | 3/1998 |
| WO | PCT/RU97/000299 | 9/1998 |
| WO | WO 00/02653 | 1/2000 |
| WO | WO 00/71235 | 1/2000 |
| WO | WO 00/09236 | 2/2000 |
| WO | PCT/RU00/000118 | 4/2000 |
| WO | WO 00/37143 | 6/2000 |
| WO | WO 01/36105 | 5/2001 |
| WO | WO 01/76764 | 10/2001 |
| WO | WO 01/076764 A | 10/2001 |
| WO | WO 01/94197 | 12/2001 |
| WO | WO 03/030995 | 4/2003 |
| WO | WO 03/061769 | 7/2003 |
| WO | WO 03/072952 | 9/2003 |
| WO | WO 2004/033920 | 4/2004 |
| WO | WO 2004/038031 | 6/2004 |
| WO | WO 2004/057196 | 7/2004 |
| WO | PCT/GB2005/000708 | 2/2005 |
| WO | PCT/GB2005/000720 | 2/2005 |
| WO | WO 2005/082546 | 9/2005 |
| WO | WO 2005/115555 | 12/2005 |
| WO | WO 2005/123263 | 12/2005 |
| WO | WO 2006/010949 | 2/2006 |
| WO | WO 2006/024242 | 3/2006 |
| WO | WO 2006/034590 | 4/2006 |
| WO | WO 2006/132557 | 12/2006 |
| WO | WO 2007/037752 | 4/2007 |
| WO | PCT/GB2007/003492 | 9/2007 |
| WO | WO 2008/062218 | 5/2008 |
| WO | PCT/GB2008/01883 | 6/2008 |
| WO | PCT/GB2008/051042 | 11/2008 |
| WO | PCT/US08/012571 | 11/2008 |
| WO | WO 2008/135775 | 11/2008 |
| WO | WO 2008/135783 | 11/2008 |
| WO | WO 2009/060240 | 5/2009 |
| WO | PCT/GB2009/050626 | 6/2009 |
| WO | WO 2009/147443 | 12/2009 |
| WO | WO 2010/003090 | 1/2010 |
| WO | WO 2010/041080 | 4/2010 |
| WO | WO 2010/049815 | 5/2010 |

OTHER PUBLICATIONS

Machine English language translation by EPO of document B1.

Patent Abstracts of Japan, vol. 16, No. 498 (M-1325), Oct. 15, 1992 & JP 04 184000 A (Mitsui Eng & Shipbuild Co Ltd), Jun. 30, 1992.

Patent Abstracts of Japan, vol. 2002, No. 4, Aug. 4, 2002 & JP 2001 354319 A (Ogawa Jidosha:KK), Dec. 25, 2001.

Final Scientific Report, "New Regenerative Cycle for Vapor Compression Refrigeration", DE-FG36-04GO14327.

Cincotta, "From the Lab to Production: Direct Steam Injection Heating of Fibrous Slurries", Biomass Magazine, Jul. 1, 2008.

Khanal, et al., "Ultrasound Enhanced Glucose Release From Corn in Ethanol Plants", Biotechnology and Bioengineering, vol. 98, No. 5, pp. 978-985, Dec. 1, 2007.

Hagen, Energy economy by continuous steaming and mashing, International Food Information Service (IFIS), Frankfurt-Main, DE (1984).

Arvidson, et al., The VINNOVA water mist research project: A description of the 500 m3 machinery space tests, SP Swedish National Testing and Research Institute, SP Fire Technology, SP Report 2003:19.

Dlugogorski, et al., Water Vapour as an Ineiting Agent, Halon Options Technical Working Conference, pp. 7-18 (May 6-8, 1997).

High pressure water mist for efficient fire protection, Engineer Live (Oct. 8, 2007).

Kim, Andrew, Overview of Recent Progress in Fire Suppression Technology, Institute for Research in Construction, NRCC-45690, Invited Keynote Lecture of the 2nd NRIFD Symposium, Proceedings, Tokyo, Japan, Jul. 17-19, 2002, pp. 1-13.

Liu, et al., A Review of water mist fire suppression systems—fundamental studies, National Research Council Canada (2000).

Liu, et al., A Review of water mist fire suppression technology: Part II—Application studies, National Research Council Canada (Feb. 2001).

Liu, et al., Review of Three Dimensional Water Fog Techniques for Firefighting, National Research Council Canada (Dec. 2002).

Mawhinney, et al., A State-of-the-Art Review of Water Mist Fire Suppression Research and Development—1996, National Research Council Canada (Jun. 1996).

Mawhinney, et al., Report of the Committee on Water Mist Fire Suppression Systems, NFPA 750, pp. 141-147 (Nov. 2002 ROC).

Nigro, et al., Water Mist Fire Protection Solution for the Under-Roof Areas of the La Scala Theatre in Milan.

PDX® FireMist Comparative Data, Pursuit Dynamics pic (Jul. 1, 2005).

Schlosser, et al., In Situ Determination of Molecular Oxygen Concentrations in Full•Scale Fire Suppression Tests Using TDLAS, The 2nd Joint Meeting of the US Sections of the Combustion Institute, Oakland, CA (Mar. 28, 2001).

Vaari, A Study of Total Flooding Water Mist Fire Suppression System Performance using a Transient One-Zone Computer Model, Fire Technology, 37, 327-342 (2001).

Fire Suppression by Water Mist, Naval Research Laboratory, Washington, DC and Physikalisch-Chemisches Institut, Universitat Heidelberg.

Patent Abstracts of Japan, JP 03-260405, published Nov. 20, 1991.

Image File Wrapper (IFW ) of European Application No. EP20070823896, Dec. 17, 2013 from the EPO Patent Register.

(56) References Cited

OTHER PUBLICATIONS

U.S. Appl. No. 10/590,456 (Publication No. 2007-0210186 A1) Co-Pending Related U.S. Appl. No. 12/381,584.
U.S. Appl. No. 10/590,527 (Publication No. 2008-0230632 A1) Co-Pending Related U.S. Appl. No. 12/381,584.
U.S. Appl. No. 12/741,941 (Publication No. 2010-0301129 A1 A1) Co-Pending Related U.S. Appl. No. 12/381,584.
U.S. Appl. No. 12/741,995 (Publication No. 2012-0018531 A1) Co-Pending Related U.S. Appl. No. 12/381,584.
U.S. Appl. No. 12/742,046 (Publication No. 2011-0203813 A1) Co-Pending Related U.S. Appl. No. 12/381,584.
U.S. Appl. No. 12/592,930 (Publication No. 2010-0230119 A1) Co-Pending Related U.S. Appl. No. 12/381,584.
U.S. Appl. No. 12/996,348 (Publication No. 2011-0127347 A1) Co-Pending Related U.S. Appl. No. 12/381,584.

* cited by examiner

MIST GENERATING APPARATUS AND METHOD

CROSS-REFERENCE TO RELATED APPLICATIONS

The present invention is a continuation-in-part of international application no. PCT/GB2007/003492 filed Sep. 14, 2007, which claims benefit of priority based on Great Britain application no. 0618196.0 filed Sep. 15, 2006, the content of each prior application is incorporated by reference as if recited in full herein.

FIELD OF THE INVENTION

The present invention relates to the field of mist generating apparatus. More specifically, the invention is directed to an improved apparatus and methods for generating liquid droplet mists. Such apparatus and methods are useful in, e.g., fire suppression, turbine cooling, or decontamination.

BACKGROUND OF THE INVENTION

Mist generating apparatus are known and are used in a number of fields. For example, such apparatus are used in both fire suppression and cooling applications, where the liquid droplet mists generated are more effective than a conventional fluid stream. Examples of such mist generating apparatus can be found in WO2005/082545 and WO2005/082546 to the same applicant.

A problem with other conventional mist generating apparatus is that not all of the working fluid being used is atomized as it passes through the apparatus. Although the majority of the working fluid is atomized upon entry into the mixing chamber of the apparatus, some fluid is pulled into the chamber but is not atomized. The non-atomized fluid can stick to the wall of the mixing chamber and flow downstream along the wall to the outlet nozzle, where it can fall into the atomized fluid stream. This can cause the creation of droplets which are of non-uniform size. These droplets can then coalesce with other droplets to create still larger droplets, thus increasing the problem and creating a mist of non-uniform droplets.

In cooling applications in particular, the uniformity of the size of the droplets in the mist is important. In turbine cooling applications, for example, droplets which are over 10 μm in diameter can cause significant damage to the turbine blades. It is therefore important to ensure control and uniformity of droplet size. Optimally sized droplets will evaporate, thus absorbing heat energy and increasing the air density in the turbine. This ensures that the efficiency of the turbine is improved. Existing turbine cooling systems employ large droplet eliminators to remove large droplets and thus prevent damage to the turbine. However, such eliminators add to the complexity and manufacturing cost of the apparatus.

It is an aim of the present invention to obviate or mitigate one or more of the aforementioned disadvantages.

SUMMARY OF THE INVENTION

According to a first aspect of the present invention there is provided an apparatus for generating a mist, comprising: a) an elongate hollow body; and b) an elongate member co-axially located within the body such that a first transport fluid passage and a nozzle are defined between the body and the elongate member, the first transport fluid passage having a convergent-divergent internal geometry and being in fluid communication with the nozzle, wherein the elongate member includes a working fluid passage and one or more communicating openings, such as for example, bores, annuli, and combinations thereof, extending radially outwardly from the working fluid passage, the openings allowing fluid communication between the working fluid passage and the first transport fluid passage.

Preferably, the one or more communicating openings, e.g., bores are substantially perpendicular to the first transport fluid passage.

Preferably, the communicating opening, e.g. bore has an inlet connected to the working fluid passage and an outlet connected to the first transport fluid passage, the outlet having a greater cross-sectional area than the inlet.

The body has an internal wall having an upstream convergent portion and a downstream divergent portion, the convergent and divergent portions at least in part forming the convergent-divergent internal geometry of the first transport fluid passage. A first end of the elongate member has a cone-shaped projection, wherein the nozzle is defined between the divergent portion of the internal wall and the cone-shaped projection. The one or more communicating openings are adjacent the first end of the elongate member.

Preferably, the cone-shaped projection has a portion having an inclined surface rising from the surface of the cone.

In a first preferred embodiment, the elongate member further includes a second transport fluid passage having an outlet adjacent the tip of the cone-shaped projection. Preferably, the first and second transport fluid passages are substantially parallel. The second transport fluid passage preferably includes an expansion chamber.

In a second preferred embodiment, the openings, such as for example, bores, annuli, and combinations thereof, allowing communication between the working fluid passage and the first transport fluid passage are first openings, e.g., bores, and the body includes a second working fluid passage and one or more second communicating openings, e.g., bores allowing fluid communication between the second working fluid passage and the first transport fluid passage. Preferably, the second working fluid passage is located radially outward of the first working fluid passage and the first transport fluid passage. Preferably, the second openings, e.g., bores are substantially perpendicular to the first transport fluid passage. Most preferably, the first and second openings, e.g., bores are co-axial.

In a third preferred embodiment, the elongate member further includes: a) a second transport fluid passage located radially outward of the working fluid passage; b) one or more first communicating openings, such as for example, bores, annuli, and combinations thereof, extending radially outward from the working fluid passage, the first openings allowing fluid communication between the working fluid passage and the second transport fluid passage; and c) one or more second communicating openings extending radially outward from the second transport fluid passage, the second openings allowing fluid communication between the second transport fluid passage and the first transport fluid passage, wherein the first and second communicating openings are substantially perpendicular to the second and first transport fluid passages, respectively.

Preferably, the elongate member further includes a third transport fluid passage adapted to supply transport fluid into the second transport fluid passage adjacent the first and second communicating openings, e.g., bores.

Alternatively, the first transport fluid passage communicates with the nozzle via an outlet and a second transport fluid passage in fluid communication with the outlet, wherein the second transport fluid passage has a convergent-divergent internal geometry and is substantially perpendicular to the first transport fluid passage.

As a further alternative, the apparatus further comprises a mixing chamber located between the first transport fluid passage and the nozzle, and a second transport fluid passage in communication with the mixing chamber and the first transport fluid passage, wherein the second transport fluid passage is adapted to supply transport fluid to the mixing chamber in a direction of flow substantially opposed to a direction of flow of transport fluid from the first transport fluid passage.

According to a second aspect of the invention, there is provided a method of generating a mist, the method comprising the steps of: a) supplying a working fluid through a working fluid passage; b) supplying a first transport fluid through a first transport fluid passage; c) forcing the working fluid from the working fluid passage into the first transport fluid passage via one or more communicating openings, such as for example, bores, annuli, and combinations thereof, extending radially outward from the working fluid passage; d) accelerating the first transport fluid upstream of the communicating openings so as to provide a high velocity transport fluid flow; and e) applying the high velocity transport fluid flow to the working fluid exiting the communicating openings, thereby imparting a shear force on the working fluid and atomizing the working fluid to produce a dispersed droplet flow regime.

Preferably, the high velocity transport fluid flow is applied substantially perpendicular to the working fluid flow exiting the openings, e.g., bores.

Preferably, the step of accelerating the first transport fluid is achieved by providing the first transport fluid passage with a convergent-divergent internal geometry and forcing the first transport fluid through the convergent-divergent portion.

Preferably, the method further includes the steps of: a) forcing the atomized working fluid from the first transport fluid passage into a second transport fluid passage via one or more second communicating openings, such as for example, bores, annuli, and combinations thereof, extending radially outwardly from the first transport fluid passage; b) supplying a second transport fluid through the second transport fluid passage; c) accelerating the second transport fluid upstream of the second communicating openings so as to provide a second high velocity transport fluid flow; and d) applying the second high velocity transport fluid flow to the atomized working fluid exiting the second communicating openings, thereby imparting a second shear force on the atomized working fluid and further atomizing the working fluid.

Preferably, the second high velocity transport fluid flow is applied substantially perpendicular to the atomized working fluid flow exiting the second openings.

Another embodiment of the invention is a mist for fire suppression, which mist is produced using any of the apparati disclosed herein.

A further embodiment of the invention is a fire suppression system comprising any of the mist generating apparati disclosed herein. For example, one mist generating apparatus according to this embodiment includes: a) an elongate hollow body; and b) an elongate member located within the body such that a first transport fluid passage and a nozzle are defined between the body and the elongate member, the first transport fluid passage having a convergent-divergent internal geometry and being in fluid communication with the nozzle, wherein the elongate member includes a working fluid passage and one or more communicating openings extending radially outwardly from the working fluid passage, the openings allowing fluid communication between the working fluid passage and the first transport fluid passage.

BRIEF DESCRIPTION OF THE DRAWINGS

Preferred embodiments of the present invention will be described, by way of example only, with reference to the accompanying drawings.

DETAILED DESCRIPTION OF THE INVENTION

Figure 1A:
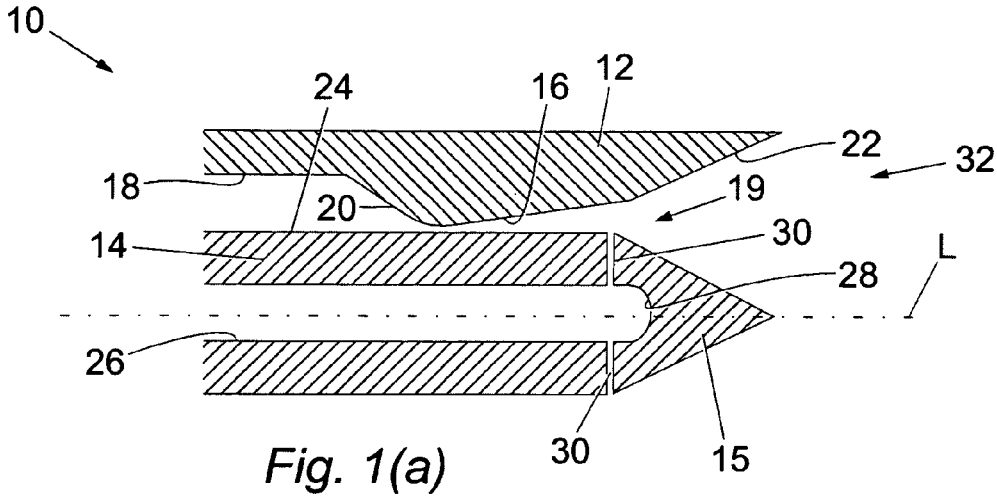
FIGS. 1(*a*)-1(*e*) show detail section views of a first embodiment of a mist generating apparatus and potential modifications thereto.
Figure 1B:
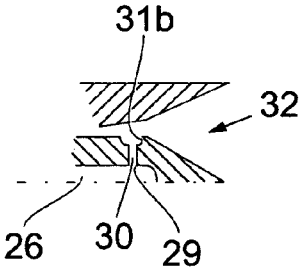
Figure 1C:
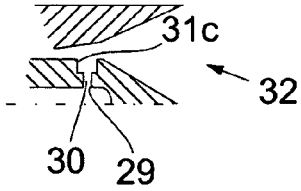
Figure 1D:
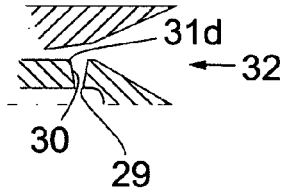
Figure 1E:
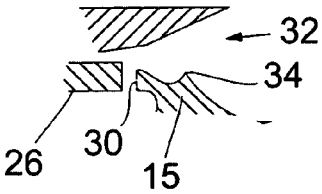

In this specification the terms "convergent", "divergent" and "convergent-divergent" have been used to describe portions of components which define passages, as well as to describe the internal geometry of the passages themselves. A "convergent" portion or section reduces the cross sectional area of a passage, whilst a "divergent" portion or section increases the cross-sectional area of a passage. A passage having "convergent-divergent" internal geometry is a passage whose cross-sectional area reduces to form a throat section before increasing again.

FIG. 1(*a*) shows a first embodiment of a mist generating apparatus according to the present invention. The apparatus, generally designated 10, comprises an elongate hollow body 12 which is preferably cylindrical and an elongate member 14 projecting co-axially within the body 12. The member 14 and body 12 are so arranged that a first transport fluid passage 16 and a nozzle 32 are defined between the two. The body 12 has an internal wall 18 which includes a convergent portion 20 upstream of a divergent portion 22. The elongate member 14 has an external wall 24 which is substantially straight and parallel to the longitudinal axis L shared by the body and elongate member. As FIG. 1(*a*) is a detail view, it will be appreciated that the entire apparatus is not illustrated in this figure. As the body 12 is generally cylindrical, a further portion of the body 12, mirrored about the longitudinal axis L, is present below the elongate member 14, but is not shown in FIG. 1(*a*) for reasons of clarity. Thus, the body 12 and passage 16 surround the elongate member 14. The elongate member 14 ends in a cone-shaped projection 15 at the remote end thereof.

The elongate member 14 includes a working fluid passage 26 for the introduction of a working fluid. The passage will therefore be referred to as the working fluid passage 26. The working fluid passage 26 extends along the length of the elongate member 14 and is also co-axial with the body 12 and elongate member 14. The working fluid passage 26 is blind, in that it ends in a cavity 28 located in the cone 15 of the elongate member 14. Extending radially outward from the working fluid passage 26, and preferably in a direction substantially perpendicular to the transport fluid passage 16, are one or more communicating openings, such as for example, bores, annuli, and combinations thereof, 30. These openings 30 allow fluid communication between the working fluid passage 26 and the transport fluid passage 16. The cone 15 of the elongate member 14 and the divergent portion 22 of the internal wall 18 define a mixing chamber 19 which opens out into a nozzle 32 through which fluid is sprayed.

The operation of the first embodiment will now be described. A working fluid, such as water for example, is introduced from a working fluid inlet (not shown) into the working fluid passage 26. In addition to water, the working fluid may be any appropriate material capable of flowing though the apparati of the invention for achieving the desired result, e.g., fire suppression, turbine cooling, or decontamination. Thus, for example, with respect to decontamination, water and/or other decontaminating, disinfecting and/or neutralizing agent(s) well known in the art may be used as the working fluid. The working fluid flows along the working fluid passage 26 until reaching the cavity 28. Upon reaching the cavity 28, the working fluid is forced under pressure through the openings 30 into the transport fluid passage 16. A transport fluid, such as steam for example, is introduced from a transport fluid inlet (not shown) into the transport fluid passage 16. Due to the convergent-divergent section of the passage 16 formed by the convergent and divergent portions 20,22 of the body 18, the transport fluid passage 16 acts as a venturi section, accelerating the transport fluid as it passes through the convergent-divergent section into the mixing chamber 19. This acceleration of the transport fluid ensures that the transport fluid flows past the ends of the openings 30 at very high velocity, such as, e.g., super- and sub-sonic velocity.

With the transport fluid flowing at high velocity and the working fluid exiting the openings 30 into the passage 16, the working fluid is subjected to very high shear forces by the transport fluid as it exits the openings 30. Droplets are sheared from the working fluid flow, producing a dispersed droplet flow regime. The atomized flow is then carried from the mixing chamber 19 to the nozzle 32. In such a manner, the apparatus 10 creates a flow of substantially uniform sized droplets from the working fluid. See, e.g., Table 1.

FIGS. 1(*b*)-1(*e*) show examples of modifications that may be made to the openings 30. FIGS. 1(*b*)-1(*d*) show openings, such as, e.g., bores 30 where the bore outlet has a greater cross-sectional area than the bore inlet 29 communicating with the working fluid passage 26. In FIG. 1(*b*) the opening, such as, e.g., bore 30 has a curved outward taper at the outlet 31*b* which provides the outlet 31*b* with a bowl-shaped profile when viewed in section. In FIG. 1(*c*), a similar arrangement is shown, but here the expanded diameter of the outlet 31*c* is achieved by providing a stepped portion rather than a gradual outward taper. With the nozzle of FIG. 1(*d*), the opening, such as, e.g., bore 30 gradually tapers outwards along the length thereof from inlet 29 to outlet 31*d*.

By providing openings, such as, e.g., bore 30 whose outlets 31*b*,31*c*,31*d* are of greater diameter than their respective inlets 29, an area of lower pressure is provided in the working fluid as it leaves the outlets 31*b*,31*c*,31*d*. This has the effect of presenting a greater surface area of working fluid to the transport fluid in the mixing chamber 19, thereby further increasing the shear effect of the transport fluid on the working fluid. Additionally, the expansion of the openings, such as, e.g., bores 30, particularly in the cases of the FIGS. 1(*b*) and 1(*c*) nozzles, will increase the turbulence of the working fluid flow as it exits the openings 30, limiting the potential for any of the working fluid flow to become trapped along the walls of the openings 30.

As explained above, one potentially undesirable phenomenon in mist generating apparatus is that some of the working fluid is not instantly atomized upon exit from the openings 30. In such instances, the non-atomized fluid can flow along the wall of the cone 15 in the nozzle 32 and then potentially disrupt the size of the working fluid droplets which have already been atomized. This phenomenon, if present, may be minimized and/or avoided in the modified nozzle shown in FIG. 1(*e*). With this nozzle, the wall of the cone 15 is provided with a portion 34 having an inclined surface rising upwardly from the surface of the cone 15 to a peak, also known as a surface separation point. Any non-atomized fluid flow along the cone 15 will flow up the inclined portion 34. Once the fluid flow arrives at the peak, it will be subjected to the shear forces of the transport fluid, causing it to atomize, and then join the remainder of the droplets as they exit the nozzle 32.

Figure 2:
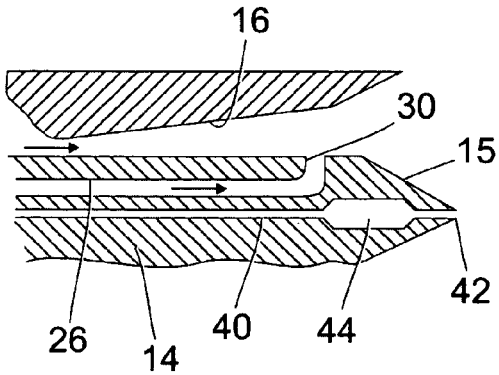
FIG. 2 shows a detail section view of a second embodiment of a mist generating apparatus.

FIG. 2 shows a second embodiment of the apparatus, which addresses the same issue as the modified nozzle of FIG. 1(*e*). In this instance, the elongate member 14 includes a working fluid passage 26 as before. However, instead of passing through the central axis of the elongate member 14 as in the previously described embodiments, in this embodiment the working fluid passage 26 is arranged so as to surround a second transport fluid passage 40 located along the longitudinal axis of the elongate member 14. The second transport fluid passage has an outlet 42 at the tip of the cone 15. The purpose of the second transport fluid passage 40 is to ensure any non-atomized fluid which flows down the outer surface of the cone 15 is atomized when it reaches the outlet 42 of the second transport fluid passage 40. Thus, transport fluid flows through both the first transport fluid passage 16 and the second transport fluid passage 40. The second transport fluid passage 40 can include an expansion chamber 44 if desired, and is preferably substantially parallel to the first transport fluid passage 16.

Figure 3:
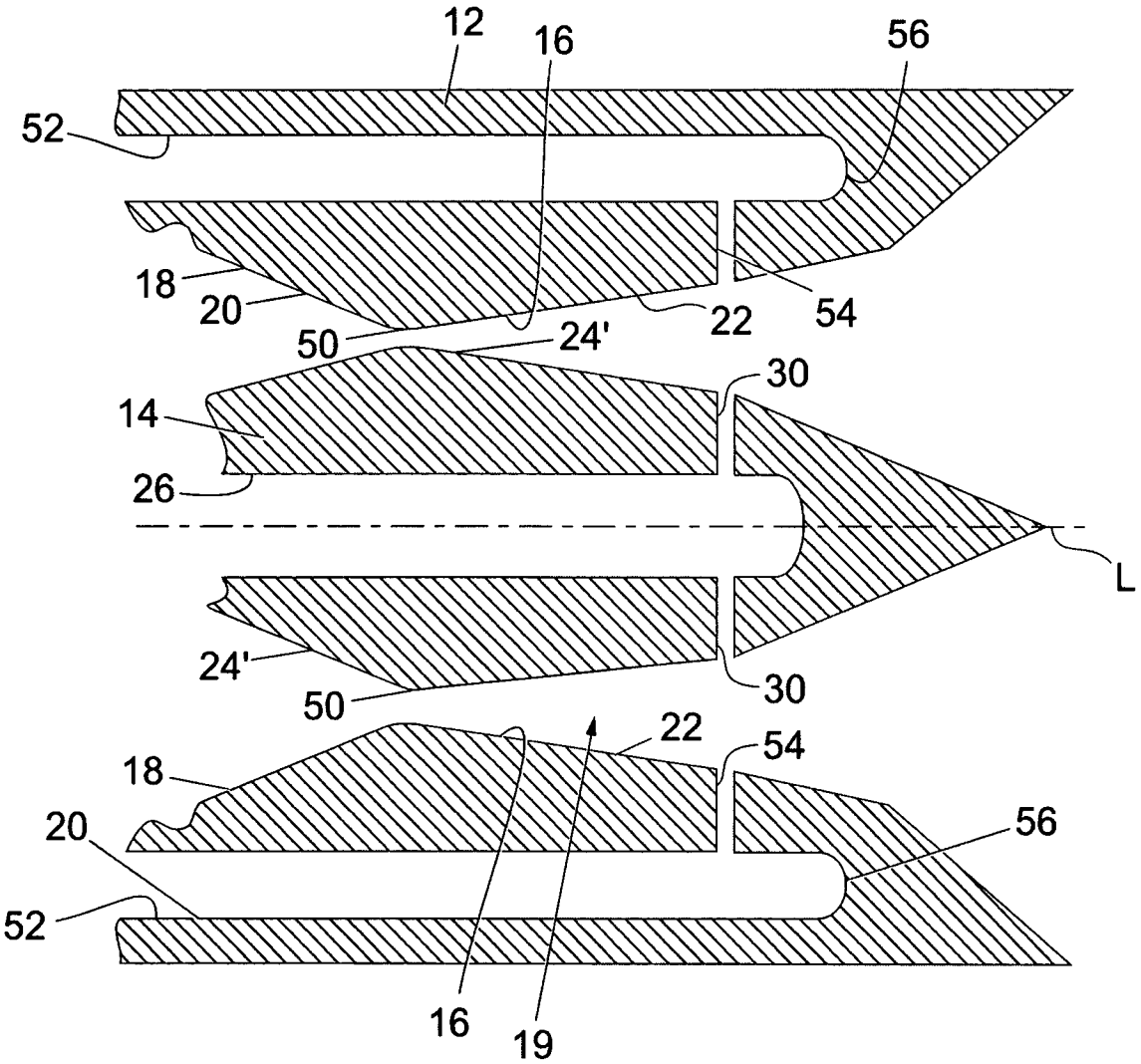
FIG. 3 shows a section view of a third embodiment of a mist generating apparatus.

A third embodiment of the apparatus is shown in FIG. 3. This embodiment shares a number of features with the first embodiment described above. As a result, these features will not be described again in detail here, but have been assigned the same reference numbers, where appropriate. A difference between the first and third embodiments is that the external wall 24' of the elongate member 14 is of the same convergent-divergent geometry as the internal wall 18 of the body 12. Hence, the convergent and divergent portions 20,22 of the internal wall 18 are mirrored by identical portions of the external wall 24' of the elongate member 14. As a result, both walls 18,24' define a throat section 50 in the first transport fluid passage 16.

Another difference between the third embodiment of the apparatus and the preceding embodiments is that as well as having a first working fluid passage 26 along the centre of the elongate member 14, a second working fluid passage 52 is also provided in the body 12, the second working fluid passage 52 surrounding both the first working fluid passage 26 and the transport fluid passage 16 such that it is located radially outward thereof. This means that working fluid is supplied into the mixing chamber 19 from both first and second openings 30,54 which extend radially outward from their respective passages 26,52 and connect the first and second working fluid passages 26,52 with the transport fluid passage 16. As with the first working fluid passage 26, the second working fluid passage 52 is also blind, with a cavity 56 located at the end of the passage 52 remote from the working fluid inlet (not shown). The first and second openings 30,54 are preferably co-axial, as seen in section in FIG. 3. This ensures that the working fluid enters the transport fluid passage 16 at the same point from both the first and second working fluid passages 26,52. The first and second openings 30,54 are also preferably perpendicular to the transport fluid passage 16.

The third embodiment will operate in substantially the same manner as that described in respect of the first embodiment. Working fluid exiting the first and second openings 30,54 under pressure will be sheared by the transport fluid flowing through the transport fluid passage 16, thereby creating a mist of uniform sized droplets.

Figure 4A:
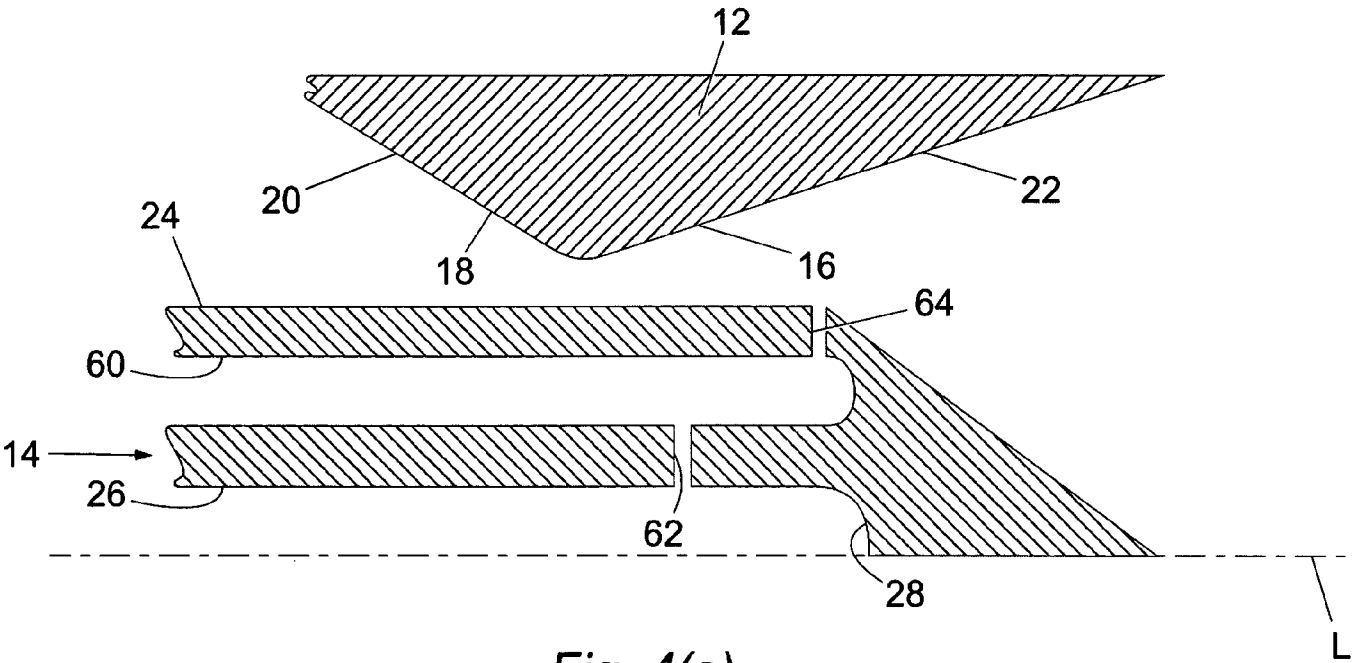
FIGS. 4(*a*)-4(*c*) show detail section views of a fourth embodiment of a mist generating apparatus and modifications thereto.
Figure 4C:
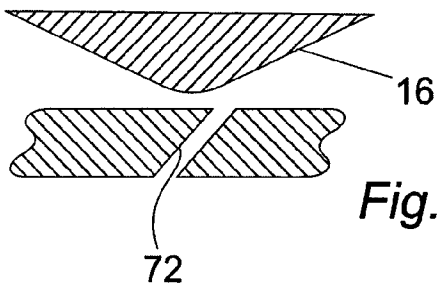
Figure 4B:
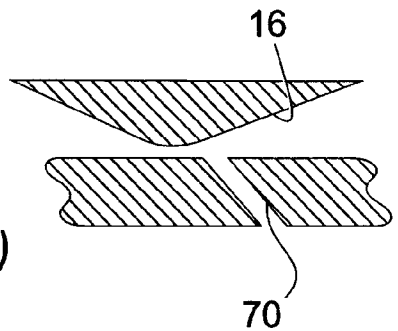

A fourth embodiment of the invention is illustrated in FIG. 4(*a*). Again, the basic layout of the apparatus is the same as with the first embodiment, so like features have been again assigned the same reference numbers. The elongate member 14 has a central working fluid passage 26 which ends in a cavity 28 remote from a working fluid inlet (not shown). A first transport fluid passage 16 is defined by an external wall 24 of the elongate member 14 and convergent and divergent portions 20,22 of the internal wall 18 of the body 12. Again, it will be appreciated that FIG. 4(*a*) illustrates half of the apparatus, with the half not illustrated being a mirror image about the longitudinal axis L of the illustrated portion. The first transport fluid passage 16 surrounds the elongate member 14

The elongate member 14 of this fourth embodiment is adapted to include a second transport fluid passage 60 located radially outward of the central working fluid passage 26. The transport and working fluid passages 60,26 are co-axial about the longitudinal axis L. With the second transport fluid passage 60 surrounding the working fluid passage 26, the second transport fluid passage 60 lies between the working fluid passage 26 and the first transport fluid passage 16. A number of first openings 62 allow fluid communication between the working fluid passage 26 and the second transport fluid passage 60. A number of second openings 64 allow fluid communication between the second transport fluid passage 60 and the first transport fluid passage 16. In the present invention, one or more of the openings 62, 64 may be in the form of bores as shown in FIG. 4(*a*) or other equivalent structures known in the art, such as for example, annuli.

In operation, working fluid is forced through the first openings 62 under pressure into the second transport fluid passage 60, where transport fluid shears the working fluid as it enters the second transport fluid passage. The resultant atomized fluid is then forced through the second openings 64 into the first transport fluid passage 16, whereupon it is sheared for a second time by a second flow of transport fluid. Providing two locations at which the working fluid is subjected to the shear forces of the transport fluid allows the apparatus to generate still smaller droplet sizes.

FIGS. 4(*b*) and 4(*c*) illustrate examples of communicating openings, such as for example, bores, annuli, and combinations thereof, 70,72 which are not perpendicular to the flow of transport fluid through the transport fluid passage 16. The opening, e.g. bore 70 of FIG. 4(*b*) presents fluid into the transport fluid flow at an angle of less than 90 degrees such that the fluid flows against the flow of transport fluid. Such an arrangement increases the shear forces on the working fluid from the transport fluid. In FIG. 4(*c*) the opening, e.g. bore 72 is at an angle of over 90 degrees, so that the fluid flow is at an angle to the transport fluid flow, but is not perpendicular thereto. This arrangement reduces the amount of shear imparted on the working fluid by the transport fluid.

Figure 5:
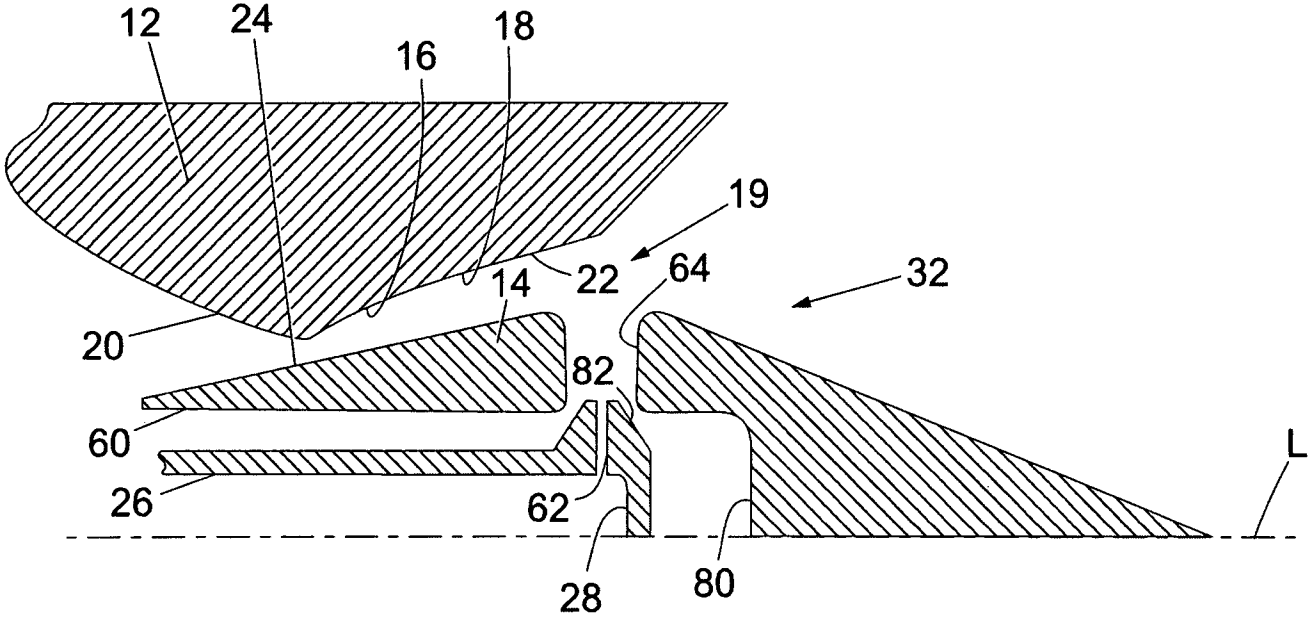
FIG. 5 shows a detail section view of a fifth embodiment of a mist generating apparatus.

A fifth embodiment of the invention is illustrated in FIG. 5. This embodiment shares a number of features with the first embodiment disclosed above. As a result, these features will not be repeated here, but have been assigned the same references numbers, where appropriate. The elongate member 14 has a central working fluid passage 26 which ends in a cavity 28 remote from a working fluid inlet (not shown). A first transport fluid passage 16 is defined by an external wall 24 of the elongate member 14 and convergent and divergent portions 20,22 of the internal wall 18 of the body 12. In this embodiment, the external wall 24 of the elongate member 14 tapers outwardly towards the body 12 in the direction of flow until it reaches one or more second openings 64. Again, it will be appreciated that FIG. 5 illustrates half of the apparatus, with the half not illustrated being a mirror image about the longitudinal axis L of the illustrated portion.

The elongate member 14 of this fifth embodiment is adapted to include a second transport fluid passage 60 located radially outward of the central working fluid passage 26. The transport and working fluid passages 60,26 are co-axial about the longitudinal axis L. With the second transport fluid passage 60 surrounding the working fluid passage 26, the second transport fluid passage lies radially between the working fluid passage 26 and the first transport fluid passage 16. One or more first openings 62 allow fluid communication between the working fluid passage 26 and the second transport fluid passage 60. One or more of the second openings 64 allow fluid communication between the second transport fluid passage 60 and the first transport fluid passage 16.

A difference between the fifth embodiment and the preceding fourth embodiment is that a third transport fluid passage 80 is provided in the elongate member 14. The third transport fluid passage 80 may receive transport fluid from the same source as the first and second transport fluid passages 16,60, or it may have its own dedicated transport fluid source (not shown). The third transport fluid passage 80 has an outlet 82 which is adjacent the outlet(s) of the first opening(s) 62. As a result, the outlets of the second and third transport fluid passages 60,80 are positioned either side of the first openings 62 and open into the second openings 64. Furthermore, the second and third transport fluid passages 60,80 optionally have a convergent-divergent geometry as shown in FIG. 5. Thus, in the present invention, one of or both of the second and third transport fluid passages 60,80 may have a convergent-divergent geometry. As will be appreciated by one skilled in the art, the convergent-divergent geometry as shown, e.g., in FIG. 5 may be utilized, depending on what level of shear and what velocity of transport fluid flow are required when the transport fluid interacts with the working fluid to achieve certain desired plume characteristics as disclosed herein.

In operation, working fluid is forced through the first openings 62 under pressure from the working fluid passage 26, where transport fluid from the second and third transport fluid passages 60,80 shears the working fluid. The resultant atomized fluid then flows through the second openings 64 into the first transport fluid passage 16, whereupon it is sheared for a second time by a second flow of transport fluid. Providing two locations at which the working fluid is subjected to the shear forces of the transport fluid allows the apparatus to generate still smaller droplet sizes. By providing two sources of transport fluid from the second and third transport fluid passages 60,80 adjacent the first opening(s) 62, even smaller droplets of the working fluid can be obtained due to the effective twin shear action of the transport fluid on the working fluid prior to the atomized fluid entering the second opening(s) 64 and being further atomized. See, e.g., Table 1.

Figure 6:
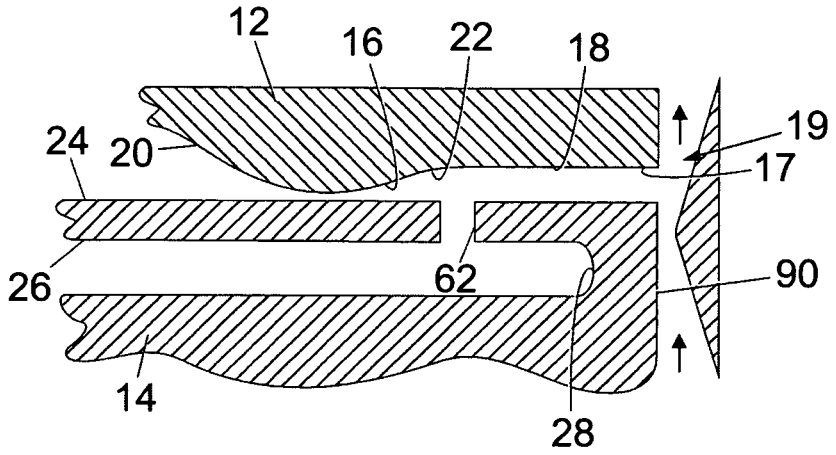
FIG. 6 shows a detail section view of a sixth embodiment of a mist generating apparatus.
Figure 7:
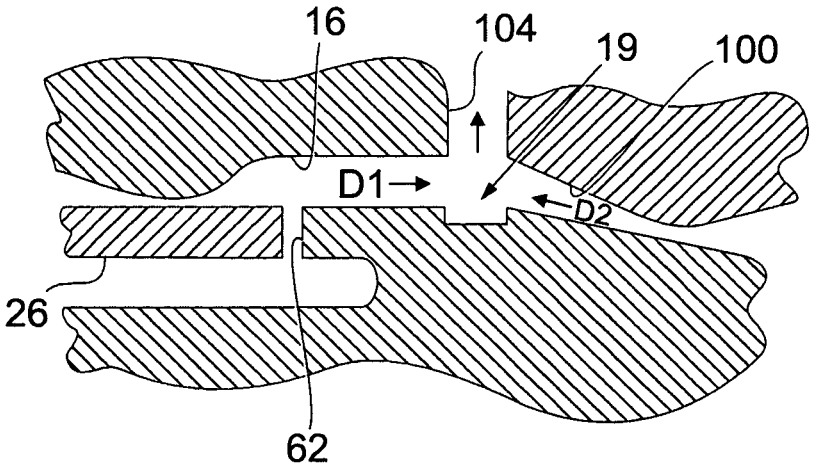
FIG. 7 shows a detail section view of a seventh embodiment of a mist generating apparatus.

FIGS. 6 and 7 show sixth and seventh embodiments of the apparatus, respectively, in which secondary shear actions take place in the manner of the fourth and fifth embodiments described above. In the sixth embodiment shown in FIG. 6, the elongate member 14 has a working fluid passage 26 which ends in a cavity 28 remote from a working fluid inlet (not shown). A first transport fluid passage 16 is defined by an external wall 24 of the elongate member 14 and convergent and divergent portions 20,22 of the internal wall 18 of the body 12. The external wall 24 of the elongate member 14 runs substantially parallel to the working fluid passage 26. One or more first openings 62 allow fluid communication between the working fluid passage 26 and the first transport fluid passage 16.

A difference between the sixth embodiment and the fifth embodiment is that a second transport fluid passage 90 is provided, but in this case the second transport fluid passage 90 is substantially perpendicular to the first transport fluid passage 16. The second transport fluid passage 90 may receive transport fluid from the same source as the first transport fluid passage 16, or else it may have its own dedicated transport fluid source (not shown). In this embodiment, the first transport fluid passage 16 has an outlet 17 in communication with the second transport fluid passage 90. A mixing chamber 19 is defined where the first and second transport fluid passages 16,90 meet one another. The second transport fluid passage 90 has a convergent-divergent internal geometry upstream of the first transport fluid passage outlet 17, thereby ensuring that the transport fluid passing through the passage 90 is accelerated prior to meeting the atomized fluid exiting the first transport fluid passage 16.

In operation, working fluid is forced through the first openings 62 from the working fluid passage 26, where transport fluid from the first transport fluid passage 16 shears the working fluid. The resultant atomized fluid then flows through the outlet 17 into the second transport fluid passage 90, whereupon it is sheared for a second time by the second flow of transport fluid.

The seventh embodiment of the invention differs from the sixth embodiment, for example, in that the second transport fluid passage 100 is arranged such that the direction of the second transport fluid flow is generally opposite to the flow of transport fluid through the first transport fluid passage 16. As before, both the first and second transport fluid passages 16,100 have convergent-divergent internal geometry.

Working fluid exits the working fluid passage 26 via first opening(s) 62 in a flow direction preferably perpendicular to the first transport fluid passage 16. Transport fluid accelerated through the transport fluid passage 16 shears the working fluid exiting the opening(s) 62, creating an atomized fluid flow. The atomized fluid flow, flowing in the direction indicated by arrow D1, then meets the accelerated opposing secondary transport fluid flow, illustrated by arrow D2, at a mixing chamber 19. The two fluid flows D1,D2 collide in the mixing chamber 19 to further atomize the working fluid prior to the atomized working fluid exiting via outlet 104.

A purpose of the sixth and seventh embodiments is to shear the working fluid once and then carry the droplets into a further stream of transport fluid where it is sheared again to further atomize the fluid. Thus, in one exemplary aspect of these embodiments, the velocity of the droplets may be reduced by using a lower velocity fluid flow through the second transport fluid passage. This allows the production of uniform droplets by shearing with a first, preferably supersonic, stream of transport fluid and then reducing the velocity of the stream with the second transport fluid flow. More particularly, and by way of example only, the first transport fluid may be used at very high velocities to apply high shear and atomize the flow, then the second transport fluid may also be used at high velocities for another round of high shear. In this aspect, the velocity of the first and second transport fluids may be extremely high, including supersonic. In another aspect, the second transport fluid may be used at a lower velocity (compared to the first transport fluid) to slow the droplets, yet still providing a shearing effect. As one skilled in the art would recognize, such a configuration may be appropriate for applications requiring small droplet size but low projection velocities, such as for example, to feed a turbine. In addition, the 90° change of direction of the flow under the influence of the geometry of the second transport fluid nozzle also influences the plume characteristics.

Each of the embodiments described here preferably uses a generally perpendicular arrangement of the working fluid openings, such as for example, bores, annuli, and combinations thereof, and transport fluid passages to obtain a crossflow of the transport and working fluids. This crossflow (where the two fluid flows meet at approximately 90 degrees to one another) ensures the penetrative atomization of the working fluid as the transport fluid breaks up the working fluid. The natural Kelvin-Helmholtz/Rayleigh Taylor instabilities in the working fluid as it is forced into an ambient pressure environment also assist the atomization of the working fluid.

Furthermore, by locating the elongate member 14 along the centre of the apparatus, the atomized working fluid exits the apparatus via an annular nozzle which surrounds the elongate member. The elongate member creates a low pressure recirculation zone adjacent the cone 15. As the high-speed atomized working fluid exits the annular nozzle it imparts further shear forces on the droplets in the recirculation zone, leading to a further atomization of the working fluid.

In the fifth embodiment shown in FIG. 5, the method of operation may be adapted by swapping the functions of the fluid passages 26,60,80. In other words, the passage 26 may supply the transport fluid, whilst the passages 60,80 may supply the working fluid. In an alternative adaptation of the apparatus of the fifth embodiment, the apparatus may be adapted to feed gas bubbles through the first openings 62 as the working fluid passes through. This has the effect of breaking up the working fluid stream prior to atomization and also increasing turbulence in the working fluid, both of which help improve the atomization of the working fluid in the apparatus.

The following example is provided to further illustrate the methods and apparati of the present invention. The example is illustrative only and is not intended to limit the scope of the invention in any way.

EXAMPLE 1

The results presented in Table 1 below were obtained using a Particle Droplet Image Analysis (PDIA) system (Oxford Lasers Ltd (UK)), which makes use of a high frame rate laser firing across the spray plume into an optical receiver (camera). The PDIA system uses a spherical fitting algorithm (Oxford Lasers Ltd (UK)) to apply a diameter to the droplets in the image that it has captured.

The data presented below were measured 6 m and/or 10 m from each nozzle as this allowed good particle observation with the PDIA system, but also represented typical plume characteristics for each nozzle. Having determined the droplet sizes present in the plume, the data was further analyzed to calculate the $D_v90$, which is a common measurement parameter used in industry. The $D_v90$ is the value where 90 percent of the total volume of liquid sprayed is made up of drops with diameters smaller than or equal to this value (similarly $D_v50$ is for 50%).

The results summarized in Table 1 were generated using two representative nozzles according to the present invention. One nozzle was within the scope of FIG. 1*a* ("First Embodiment") and one was within the scope of FIG. 5 ("Fifth Embodiment"). For the Fifth Embodiment nozzle, the data were obtained with the gas through the second transport fluid passage either off ("No gas") or turned to its maximum ("Gas").

TABLE 1

| Nozzle | Gas | Measurement location downstream of nozzle [m] | Steam mass flow rate [kg/min] | Water mass flow rate [kg/min] | Steam Pressure [barG] | Gas Pressure [barG] | $D_v90$ [μm] | $D_v50$ [μm] |
|---|---|---|---|---|---|---|---|---|
| First Embodiment | N/A | 10 | 3.05 | 6.8 | 14 | N/A | 1.65 | 1.42 |
| Fifth Embodiment | No gas | 6 | 2.96 | 6.8 | 14 | 0 | 1.6 | 1.4 |
| | | 10 | 2.96 | 6.7 | 14 | 0 | 2.0 | 1.5 |
| | Gas | 6 | 2.96 | 6.9 | 14 | 9 | 1.5 | 1.32 |
| | | 10 | 2.96 | 6.9 | 14 | 9 | 1.6 | 1.42 |

Measurements taken at 5° off centre line and 99 percentile of all measured particles.

As the data show, both nozzles generated plumes containing substantially improved properties, including, e.g., smaller, substantially uniform droplet sizes (i.e., diameters). Thus, the apparati of the present invention may produce plumes with a $D_v90$ of 2 μm or below, such as 1.6 μm or below, or 1.5 μm or below.

The present invention is not to be limited in scope by the specific embodiments described herein. Indeed, various modifications of the invention in addition to those described herein will become apparent to those skilled in the art from the foregoing description and the accompanying figures. For example, the apparati, methods, and mists according to the present invention may be used for, or incorporated into systems/applications that would benefit from the improved liquid droplet mists disclosed herein including, fire suppression systems, turbine cooling systems, and decontamination applications, such as, e.g., surface and airborne chemical, biological, radiological, and nuclear decontamination applications. All such modifications are intended to fall within the scope of the appended claims.

What is claimed is:

1. An apparatus for generating a mist comprising:

a) an elongate hollow body; and b) an elongate member located within the body such that a first transport fluid passage and a nozzle are defined between the body and the elongate member, the first transport fluid passage having a convergent-divergent internal geometry that forms a throat section and being in fluid communication with the nozzle, wherein the elongate member includes:

(i) a working fluid passage;

(ii) one or more first communicating openings positioned down-stream of the throat section and extending radially outwardly from the working fluid passage, the first communicating openings allowing fluid communication between the working fluid passage and the first transport fluid passage; and (iii) one or more second communicating openings positioned down stream of the throat section and extending radially outward a second transport fluid passage, the second communicating, openings allowing fluid communication between the working fluid passage and the second transport fluid passage within the second communication openings, wherein the first and second communicating openings are substantially perpendicular to the second and first transport fluid passages, respectively; and (iv) a third transport fluid passage adapted to supply transport fluid into the second transport fluid passage adjacent the first and second communicating openings, wherein the second and third transport fluid passages adjacent the first communicating openings have a convergent-divergent geometry.

2. The apparatus of claim 1, wherein the first and second communicating openings are independently selected from the group consisting of communicating bores, communicating annuli, and combinations thereof.

3. The apparatus of claim 2, wherein the first and second communicating openings are one or more communicating bores.

4. A mist for fire suppression, which mist is produced using an apparatus according to claim 1.

5. The apparatus of claim 2, wherein the first communicating openings are one or more communicating bores and the second communicating openings are one or more communicating annuli.

6. A fire suppression system comprising a mist generating apparatus that includes:

a) an elongate hollow body; and b) an elongate member located within the body such that a first transport fluid passage and a nozzle are defined between the body and the elongate member, the first transport fluid passage having a convergent-divergent internal geometry that forms a throat section and being in fluid communication with the nozzle, wherein the elongate member includes (i) a working fluid passage;

(ii) one or more first communicating openings positioned down-stream of the throat section and extending radially outwardly from the working fluid passage, the first communicating openings allowing fluid communication between the working fluid passage and the first transport fluid passage;

(iii) one or more second communicating openings positioned down-stream of the throat section and extending radially outward a second transport fluid passage, the second communicating openings allowing fluid communication between the working fluid passage and the second transport fluid passage within the second communication openings, wherein the first and second communicating openings are substantially perpendicular to the second and first transport fluid passages, respectively; and a third transport fluid passage adapted to supply transport fluid into the second transport fluid passage adjacent the first and second communicating openings, wherein the second and third transport fluid passages adjacent the first communicating openings have a convergent-divergent geometry.

* * * * *